United States Patent [19]

Fernandez et al.

[11] 4,187,784

[45] Feb. 12, 1980

[54] SELF PROPELLED CABLE CAR

[76] Inventors: Arthur A. Fernandez, c/o George Spector 3615 Woolworth Bldg., 233 Broadway; George Spector, 3615 Woolworth Bldg., 233 Broadway, both of New York, N.Y. 10007

[21] Appl. No.: 774,906

[22] Filed: Mar. 7, 1977

[51] Int. Cl.[2] ..... B61B 7/06

[52] U.S. Cl. ..... 104/235; 74/191; 74/348; 104/93; 104/173 R

[58] Field of Search ..... 104/167, 168, 173 R, 104/183, 229, 230, 235, 236, 93; 74/348, 191, 192

[56] References Cited

U.S. PATENT DOCUMENTS

| | | | |
|---|---|---|---|
| 1,279,547 | 9/1918 | Hueber | 74/192 |
| 2,349,263 | 5/1944 | Gravinski | 104/235 |
| 2,423,323 | 7/1947 | Janette | 74/191 |
| 2,547,935 | 4/1951 | Grabinski | 104/235 |
| 2,922,625 | 1/1960 | Heacock | 104/183 |

FOREIGN PATENT DOCUMENTS

| | | | |
|---|---|---|---|
| 476338 | 4/1951 | Italy | 74/191 |

*Primary Examiner*—Joseph F. Peters, Jr.
*Assistant Examiner*—Ross Weaver

[57] ABSTRACT

A cable car for traveling along an overhead cable-way, the car having an on-board engine that powers the vehicle to haul itself along the cable-way, the engine rotating a winch drum around which is frictionally grasped a stationary hawling cable which at its oposite ends is suppoted from stationary towers.

1 Claim, 6 Drawing Figures

SELF PROPELLED CABLE CAR

This invention relates generally to overhead cable cars.

It is well known that a conventional cable car is powered to travel along a cable-way by means of a stationary engine mounted on a ground or at one of the end towers so to hawl a towing cable that pulls the car along the cable-way, and which accordingly are not directly controlled by a car operator to start and stop. This situation is not ideal so that it is therefore in want of an improvement.

Accordingly, it is a principal object of the present invention to provide a cable car that is self-propelled by being powered from an on-board engine that is thus directly controlled by an operator on board for starting or stopping.

Another object is to provide a self-propelled cable car which thus can be more precisely stopped in specific position at a station.

Other objects are to provide a self propelled cable car which is simple in design, inexpensive to manufacture, rugged in construction, easy to use and efficient in operation.

These and other objects will be readily apparent upon a study of the following specification and the accompanying drawing wherein.

Figure 1:
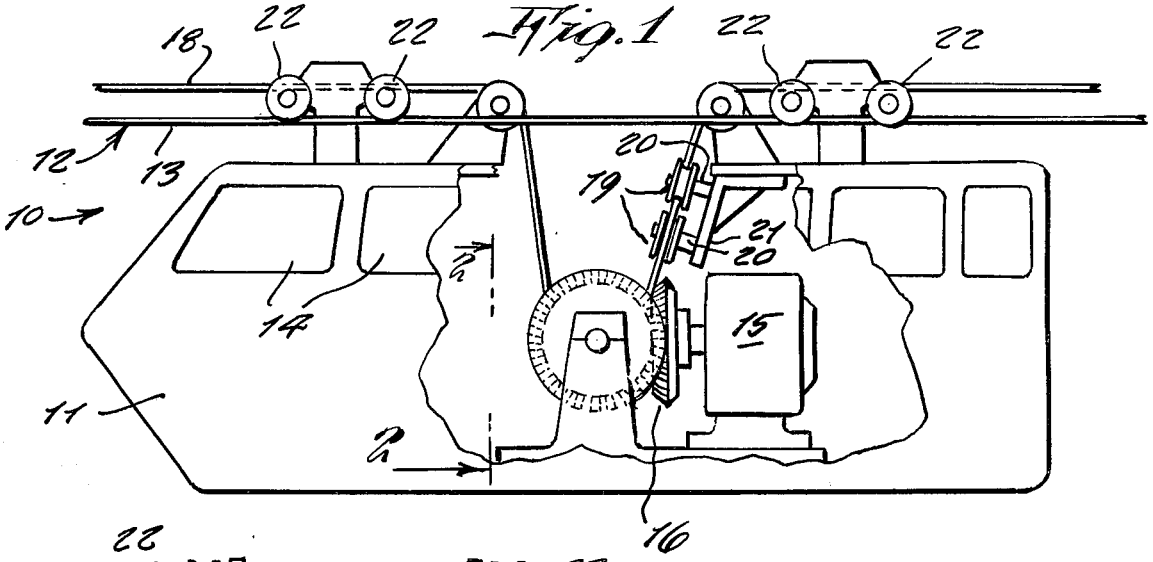
FIG. 1 is a side view of a self propelled cable car shown partly broken away to illustrate the invention therewithin, and showing one design thereof.
Figure 2:
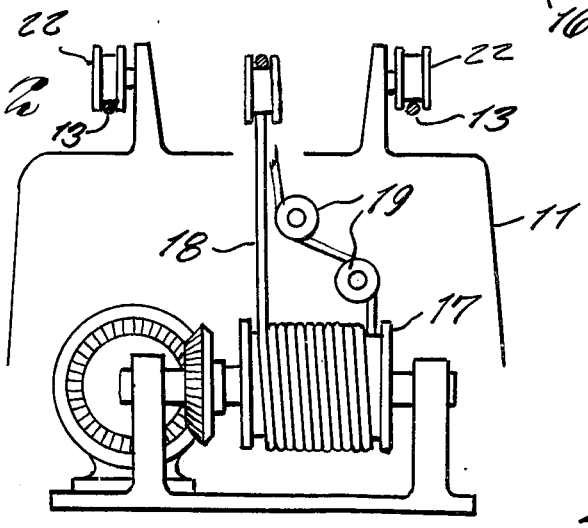
FIG. 2 is a view in direction 2—2 of FIG. 1.

Referring now to the drawing in detail and more particularly to FIGS. 1 and 2 at this time, the reference numeral 10 represents a self propelled cable car according to the present invention wherein there is a car body 11 supported from a cable-way 12 consisting of parallel, spaced apart, cables 13 so to travel overhead between towers (not shown).

The car body includes windows 14 and seats (not shown) so it may be used to carry passengers.

Inside the car body, a motor 15 through gearing 16, rotates a drum 17 so that several turns of a hawling cable 18 can be wound up therearound so to be frictionally grasped by the wrench drum in order that the car can thus hawl itself along cable 18 which is stationarily supported at its opposite ends on the towers.

Flanged wheels 22 supporting the cable car travel upon the cables 13.

In operative use, it is now evident that an operator on board the cable car can precisely control the movements of the vehicle by being able to operate the on-board engine. The engine operates the car forwardly or rearwardly in both directions.

Figure 3:
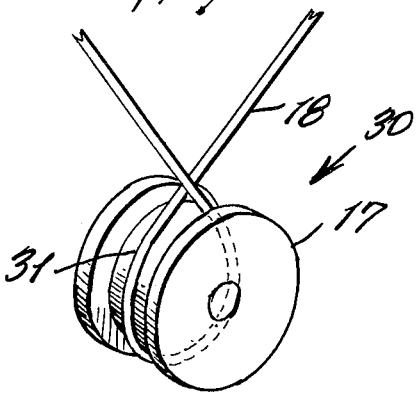
FIG. 3 shows a design in which a single turn of the cable is made around a drive roller of the cable car.
Figure 5:
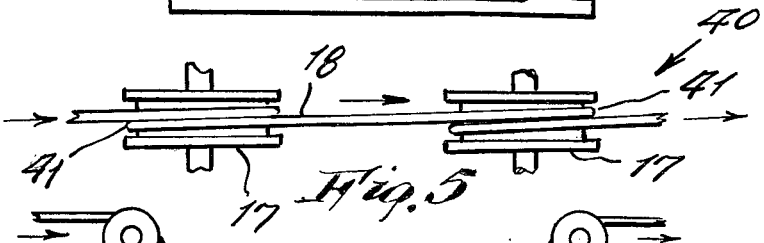
FIG. 5 is a top view thereof as viewed on line 5—5 of FIG. 4.

In FIG. 3, a slightly modified design 30 of the above described structure shows a drum 17 being used around which only a single turn 31 of the hawling cable 18 is made, instead of several turns.

Figure 4:
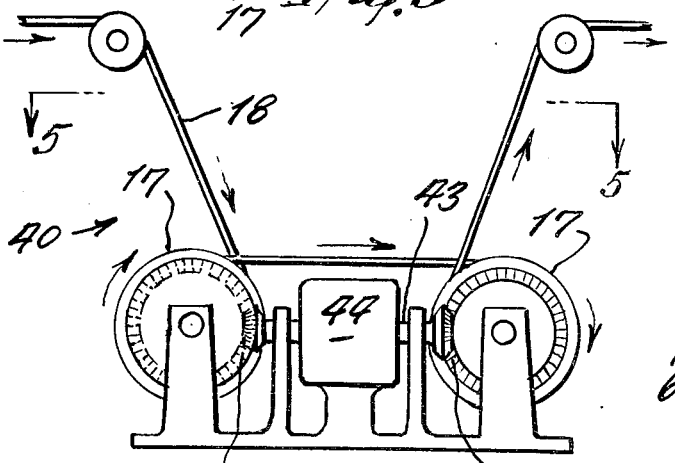
FIG. 4 shows a design that utilizes the single turn design of FIG. 3 on two drive rollers.

In FIGS. 3 and 4, still another design 40 thereof is shown wherein a single turn 41 of the hawling cable 18 is made around each of a pair of drums 17. Each drum is rotated by a gear 42 located at each opposite end of a motor shaft 43 of a motor 44. As shown, both drums rotate in a same direction.

Figure 6:
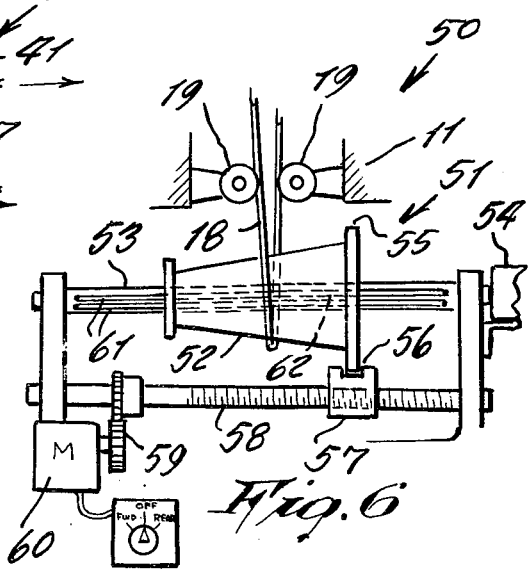
FIG. 6 shows an additional design in which speed changes can be accomplished in a gradual and smooth manner by not employing any transmission gearing.

In FIG. 6, still another design 50 of the invention shows a mechanism 51 that provides a smooth change of travel speed for the car so to not suddenly jerk ahead such as occurs when vehicles using conventional transmission gearing change between slow and higher speeds.

In this design, the mechanism 51 comprises a transmission in which the hauling cable 18 is wound around a conical shaped drum 52, the drum being slidable along a shaft 53 so that selectively either any smaller or larger diameter portion of the drum is engaged by the cable 18. Thus when a smaller diameter portion has the cable therearound, the car travels slower, and when a larger diameter portion has the cable therearound, the car travels faster. Shifting of the cable between different diameter portions can be more gradually accomplished due to the conical shape of the drum.

The drum 52 is rotated by a motor 54 turning the shaft 53, thus powering the car along the hawling cable.

The drum is slided along the shaft 53 when changing a speed by means of a flange 55 of the drum being retained in a groove 56 of a nut 57 threadingly mounted on a threaded shaft 58. When the shaft 58 is rotated through gearing 59 by a motor 60, the nut is moved along the shaft 58 thus pulling the drum with it so that larger or smaller diameter portions thereof are engaged by the hawling cable. Spliced teeth 61 on the shaft 53 engage spliced teeth 62 inside the drum, allowing the drum to slide longitudinally while still being rotatably engaged together.

While various changes may be made in the detail construction, it is understood that such changes will be within the spirit and scope of the present invention, as is defined by the appended claims.

What is claimed is:

1. A self propelled cable car, comprising a combination, a cable car having an enclosed body including flanged wheels mounted on top to be adapted for travel on a cable way, including a motor mounted in said car rotating a drum adapted to receive a hawling cable wound thereon, said drum being designed to receive multiple adjacent coils to increase frictional engagement therebetween, including means for varying the diameter of the drum engaged by said hawling cable, wherein said drum is of conical shape, said drum being engaged by splines to a splined shaft extending therethrough, said splined shaft being rotated by said motor, a flange on said drum being guided in a groove of a nut threadingly engaged on a threaded shaft which through gearing is rotated by a second motor for axially sliding said drum on said splined shaft.

* * * * *